US007137366B2

(12) United States Patent
Stephens

(10) Patent No.: US 7,137,366 B2
(45) Date of Patent: Nov. 21, 2006

(54) TWO-CYCLE SWASH PLATE INTERNAL COMBUSTION ENGINE

(75) Inventor: Thomas Glenn Stephens, Grand Prairie, TX (US)

(73) Assignee: TGS Innovations, LP, Dallas, TX (US)

( * ) Notice: Subject to any disclaimer, the term of this patent is extended or adjusted under 35 U.S.C. 154(b) by 0 days.

(21) Appl. No.: 10/939,010

(22) Filed: Sep. 10, 2004

(65) Prior Publication Data

US 2006/0054117 A1 Mar. 16, 2006

(51) Int. Cl.
*F02B 75/18* (2006.01)
*F02B 75/32* (2006.01)

(52) U.S. Cl. ..... 123/56.4

(58) Field of Classification Search ..... 123/56.3–56.6, 123/51 B, 197.4
See application file for complete search history.

(56) References Cited

U.S. PATENT DOCUMENTS

| | | | | |
|---|---|---|---|---|
| 1,682,924 | A | 9/1928 | Michell | |
| 1,698,102 | A | 1/1929 | Michell | |
| 1,804,010 | A | 5/1931 | Greening et al. | |
| 1,869,189 | A | 7/1932 | Eggert | |
| 1,895,206 | A | 1/1933 | Ricardo | |
| 2,352,396 | A | 6/1944 | Maltby | |
| 2,551,025 | A | 5/1951 | Lindeman, Jr. | |
| 3,893,295 | A | 7/1975 | Airas | |
| 3,910,242 | A | 10/1975 | Hom et al. | |
| 4,454,779 | A | 6/1984 | Vos | |
| 4,497,284 | A | 2/1985 | Schramm | |
| 4,516,536 | A | 5/1985 | Williams | |
| 4,557,232 | A | 12/1985 | DeLorean | |
| 5,027,755 | A | 7/1991 | Henry, Jr. | |
| 5,083,532 | A | 1/1992 | Wiesen | |
| 5,269,193 | A | 12/1993 | Rabinow | |
| 5,273,012 | A * | 12/1993 | Brock | 123/56.3 |
| 5,343,704 | A | 9/1994 | Kanzaki et al. | |
| 5,437,251 | A | 8/1995 | Auglim et al. | |
| 6,305,335 | B1 | 10/2001 | O'Toole | |
| 6,390,052 | B1 | 5/2002 | McMaster et al. | |

FOREIGN PATENT DOCUMENTS

| | | |
|---|---|---|
| DE | 19538197 A1 | 4/1997 |
| DE | 10126662 A1 | 5/2002 |

OTHER PUBLICATIONS

DynaCam Engine Corp. product information, date unknown, 4 pp.
DynaCam Engine Corp product information, date unknown, 2 pp.

* cited by examiner

*Primary Examiner*—Stephen K. Cronin
*Assistant Examiner*—Hyder Ali
(74) *Attorney, Agent, or Firm*—Gardere Wynne Sewell LLP

(57) ABSTRACT

A power-generation device comprising at least one cylinder, at least one cylinder head, at least one piston and an output shaft, having a central axis having a fixed angular relationship to the central axis of the cylinder. A swash plate, having a first swash plate surface having a normal axis disposed at a first fixed angle to the central axis of the output shaft, is fixed to the output shaft. At least one connecting rod is connected to at least one piston. At least one follower is secured to the second end of a connecting rod. The first follower surface contacts, and conforms to, the orientation of the first swash plate surface.

44 Claims, 8 Drawing Sheets

TWO-CYCLE SWASH PLATE INTERNAL COMBUSTION ENGINE

TECHNICAL FIELD OF THE INVENTION

The present invention relates generally to engines, and in particular to swash plate internal combustion engines.

BACKGROUND OF THE INVENTION

An internal combustion engine derives power from the volumetric compression of a fuel-air mixture, followed by a timed ignition of the compressed fuel-air mixture. The volumetric change generally results from the motion of axially-reciprocating pistons disposed in corresponding cylinders. In the course of each stroke, a piston will vary the gas volume captured in a cylinder from a minimum volume to a maximum volume. In an Otto cycle, or "four-stroke" internal combustion engine, the reciprocal motion of each piston compresses the fuel-air mixture, receives and transmits the force generated by the expanding gases, generates a positive pressure to move the spent gases out the exhaust port and generates a negative pressure on the intake port to draw in a subsequent fuel-air gas charge.

The modern internal combustion engine arose from humble beginnings. As early as the late $17^{th}$ century, a Dutch physicist by the name of Christian Huygens designed an internal combustion engine fueled with gunpowder. It is believed that Huygens' engine was never successfully built. Later, in the early nineteenth century, Francois Isaac de Rivaz of Switzerland invented a hydrogen-powered internal combustion engine. It is reported that this engine was built, but was not commercially successful.

Although there was a certain degree of early work on the idea of the internal combustion engine, development truly began in earnest in the mid-nineteenth century. Jean Joseph Etienne Lenoir developed and patented a number of electric spark-ignition internal combustion engines, running on various fuels. The Lenoir engine did not meet performance or reliability expectations and fell from popularity. It is reported that the Lenoir engine suffered from a troublesome electrical ignition system and a reputation for a high consumption of fuel. Approximately 100 cubic feet of coal gas were consumed per horsepower hour. Despite these early setbacks, a number of other inventors, including Alphonse Beau de Rochas, Siegfried Marcus and George Brayton, continued to make substantial contributions to the development of the internal combustion engine.

An inventor by the name of Nikolaus August Otto improved on Lenoir's and de Rochas' designs to develop a more efficient engine. Well aware of the substantial shortcomings of the Lenoir engine, Otto felt that the Lenoir engine could be improved. To this end, Otto worked to improve upon the Lenoir engine in various ways. In 1861, Otto patented a two-stroke engine that ran on gasoline. Otto's two-stroke engine won a gold medal at the 1867 World's Fair in Paris. Although Otto's two-stroke engine was novel, its performance was not competitive with the steam engines of the time. A successful two-stroke engine would not be developed until 1876.

In or around 1876, at approximately the same time that an inventor named Dougald was building a successful two-stroke engine, Klaus Otto built what is believed to be the first four-stroke piston cycle internal combustion engine. Otto's four-stroke engine was the first practical power-generating alternative to the steam engines of the time. Otto's revolutionary four-stroke engine can be considered the grandfather of the millions of mass-produced internal combustion engines that have since been built. Otto's contribution to the development of the internal combustion engine is such that the process of combusting the fuel and air mixture in a modern automobile is known as the "Otto cycle" in his honor. Otto received U.S. Pat. No. 365,701 for his engine.

Ten years after Klaus Otto built his first four-stroke engine, Gottlieb Daimler invented what is often recognized as the prototype of the modern gasoline engine. Daimler's engine employed a single vertical cylinder, with gasoline imparted to the incoming air by means of a carburetor. In 1889, Daimler completed an improved four-stroke engine with mushroom-shaped valves and two cylinders. Wilhelm Maybach built the first four-cylinder, four-stroke engine in 1890. The carbureted four-stroke multi-cylinder internal combustion engine became the mainstay of ground transportation from the early 1900s through the 1970s, ultimately being supplanted by fuel-injected engines in the 1980s.

SUMMARY OF THE INVENTION

The present invention is a swash-plate engine having a number of features and improvements distinguishing it not only from traditional crankshaft engines, but also from prior swash plate designs.

In a first embodiment, the present invention is a power-generation device comprising at least one cylinder having an internal volume, an internal cylinder surface, a central axis, a first end and a second end. At least one cylinder head, having an internal cylinder head surface, is disposed at, and secured to, the first end of one of the at least one cylinders. At least one piston, having an axis of motion parallel to the central axis of at least one of the cylinders, and having a crown disposed toward the internal surface of the cylinder head secured to that cylinder, is disposed in the internal volume of the cylinder. The crown of the piston, an internal cylinder surface, and the internal surface of the cylinder head for that cylinder together form a combustion chamber for that cylinder.

The first embodiment further includes an output shaft, having a central axis having a fixed angular relationship to the central axis of the cylinder. A swash plate, having a first swash plate surface having a normal axis disposed at a first fixed angle to the central axis of the output shaft, is fixed to the output shaft. At least one connecting rod, having a principal axis, a first end axially and rotationally fixed to a piston, and a second end, is secured to at least one piston. At least one follower, having a first follower surface having a normal axis disposed at the first fixed angle to the principal axis of the connecting rod to which it is secured, is secured to the second end of a connecting rod. The first follower surface contacts, and conforms to, the orientation of the first swash plate surface.

In a second embodiment, the present invention is a power-generation device comprising an output shaft, having a central axis, and at least two cylinders, disposed symmetrically about the central axis of the output shaft. Each cylinder has a central axis parallel to the central axis of the output shaft, an internal volume, an internal cylinder surface, a central axis, a first end and a second end.

At least two cylinder heads, each having an internal cylinder head surface, is disposed at, and secured to, the first end of one of the cylinders. The device includes at least two pistons, each piston having an axis of motion aligned to the central axis of a cylinder, disposed in the internal volume of the cylinder and having a crown disposed toward the internal surface of the cylinder head secured to that cylinder. The crown of the piston, an internal cylinder surface, and the internal surface of the cylinder head for that cylinder together form a combustion chamber for that cylinder.

A swash plate is fixed to the output shaft, having a swash plate clocking interface fixed to the orientation of the output shaft about the central axis of the output shaft. At least two connecting rods, each having a principal axis, a first end and a second end are each axially and rotationally fixed to a piston. At least two followers, having a follower clocking interface fixed to the orientation of the connecting rod about the principal axis of the connecting rod and the orientation of the swash plate clocking interface, are each secured to the second end of a connecting rod.

In a third embodiment, the present invention is a power-generation device comprising an output shaft, having a central axis, four cylinders, disposed symmetrically and regularly about the central axis of the output shaft and axially-movable with respect to the output shaft, four cylinder heads, and four pistons connected to a swash plate by four followers.

The four cylinders are disposed symmetrically and regularly about the central axis of the output shaft and are axially-movable with respect to the output shaft. Each cylinder has a central axis parallel to the central axis of the output shaft, an internal volume, an internal cylinder surface, a central axis, a first end and a second end. The four cylinder heads, each have an internal cylinder head surface, an intake port, and an exhaust port. Each such cylinder head is disposed at, and secured to, the first end of a cylinder.

Each of the four pistons has an axis of motion aligned to the central axis of a cylinder, is disposed in the internal volume of the cylinder, and has a crown disposed toward the internal surface of the cylinder head secured to that cylinder. The crown of the piston, an internal cylinder surface, and the internal surface of the cylinder head for that cylinder together form a combustion chamber for that cylinder.

The swash plate is fixed to the output shaft, and has a substantially-planar swash plate surface having a normal axis disposed at an angle of approximately 45 degrees to the central axis of the output shaft. The four connecting rods, each having a principal axis, a first end axially and rotationally fixed to a piston, and a second end, are connected to the swash plate by four followers, each secured to the second end of a connecting rod. Each of the followers has a substantially-planar follower surface fixed to the connecting rod and has a normal axis disposed at an angle of approximately 45 degrees to the central axis of the output shaft.

BRIEF DESCRIPTION OF THE DRAWINGS

For more complete understanding of the features and advantages of the present invention, reference is now made to the detailed description of the invention along with the accompanying Figures.

DETAILED DESCRIPTION OF THE INVENTION

Figure 1:
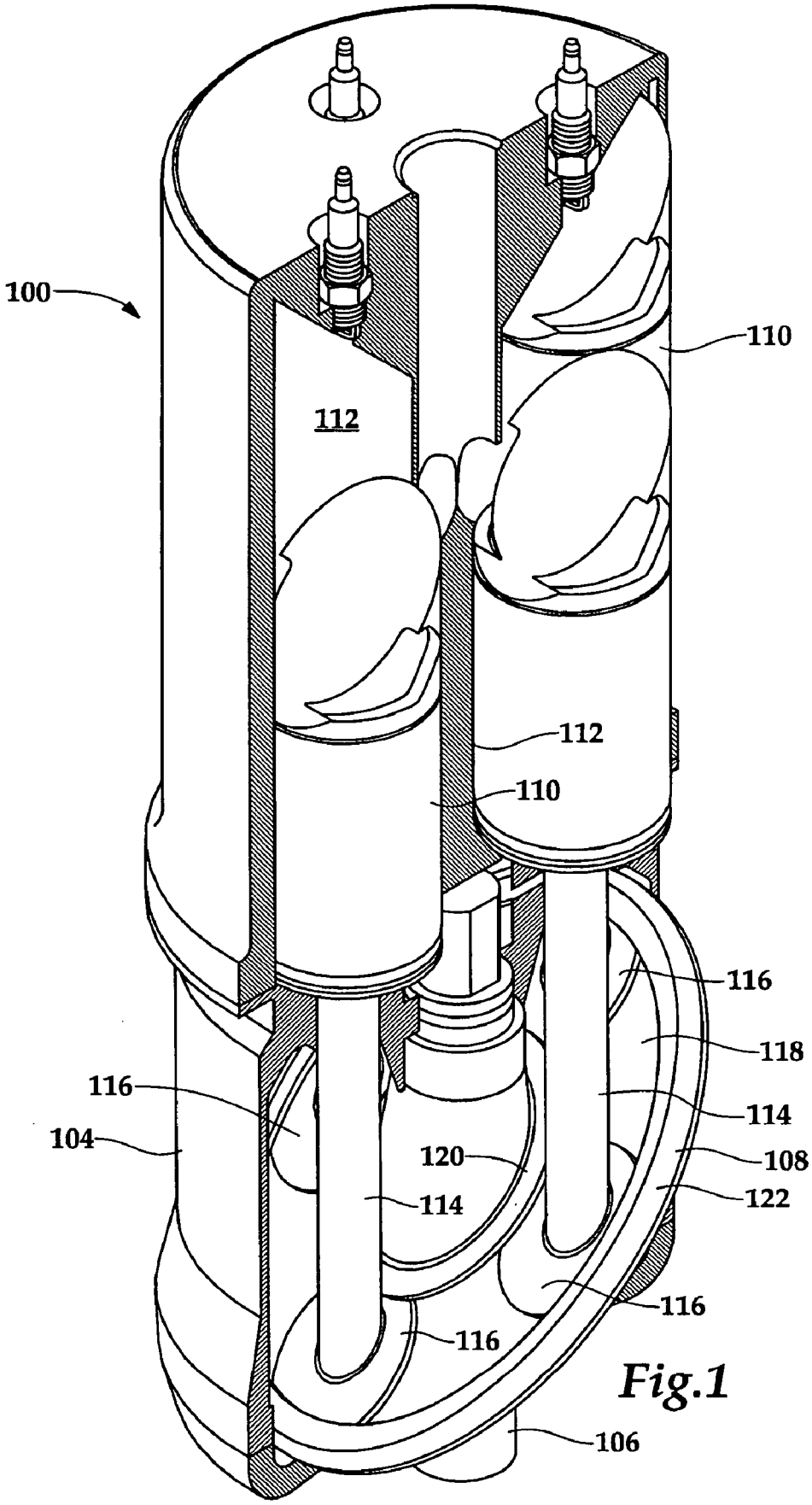
FIG. 1 depicts a partial cutaway isometric view of an internal combustion engine according to one embodiment of the present invention.
Figure 2:
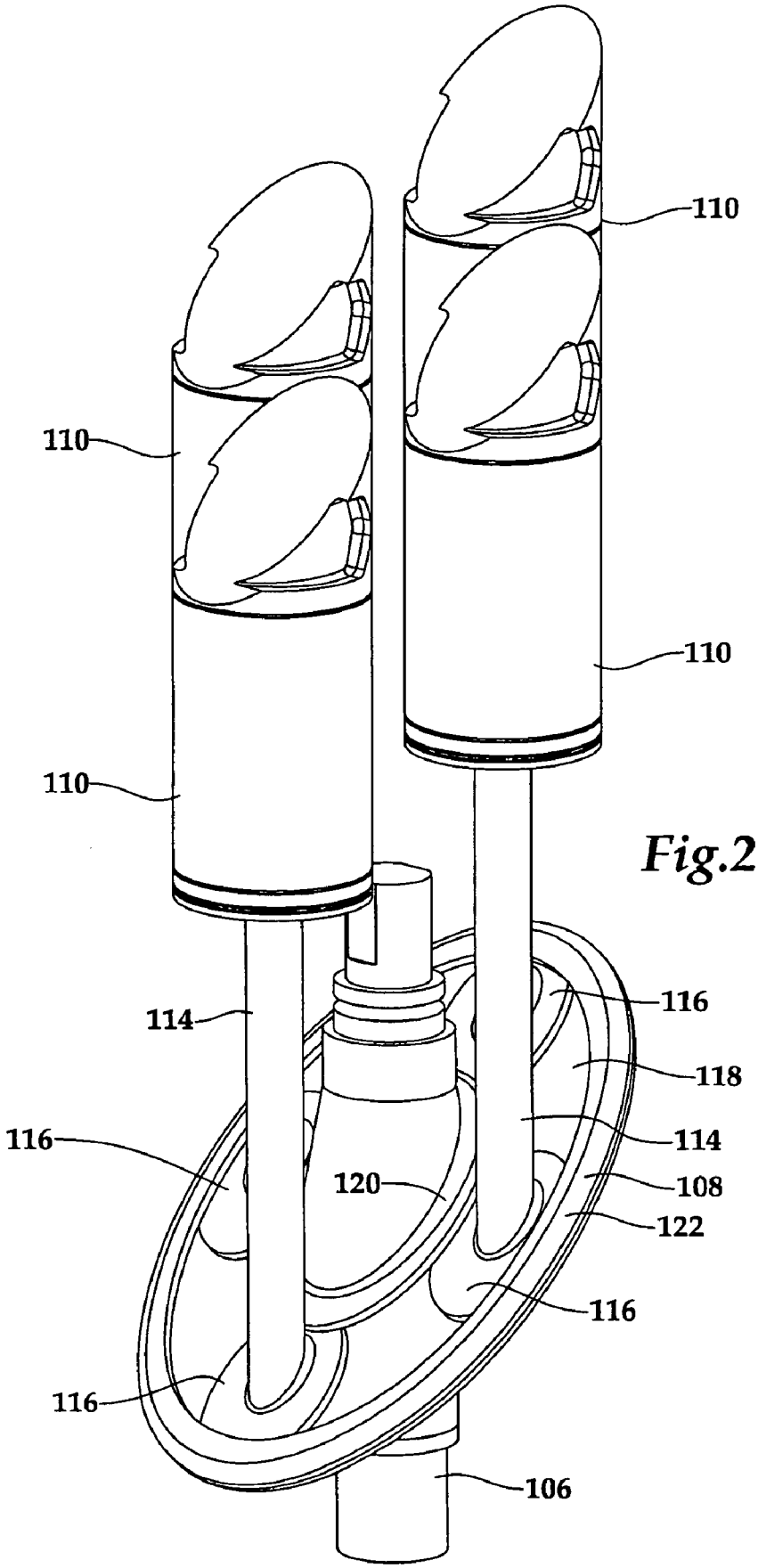
FIG. 2 depicts an isometric view of the reciprocating assembly of the internal combustion engine of FIG. 1.
Figure 3:
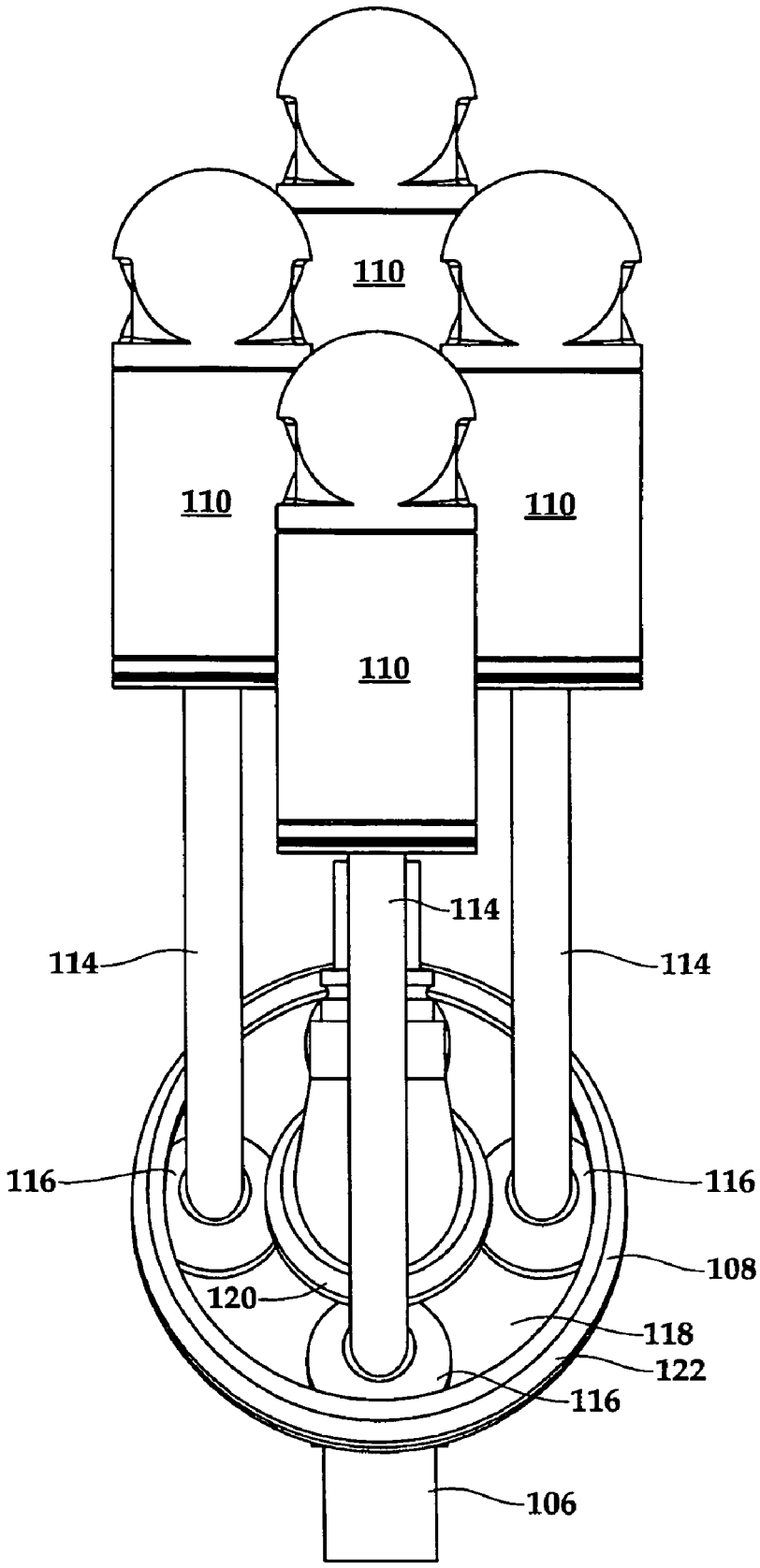
FIG. 3 depicts an front view of the reciprocating assembly of the internal combustion engine of FIG. 1.
Figure 4:
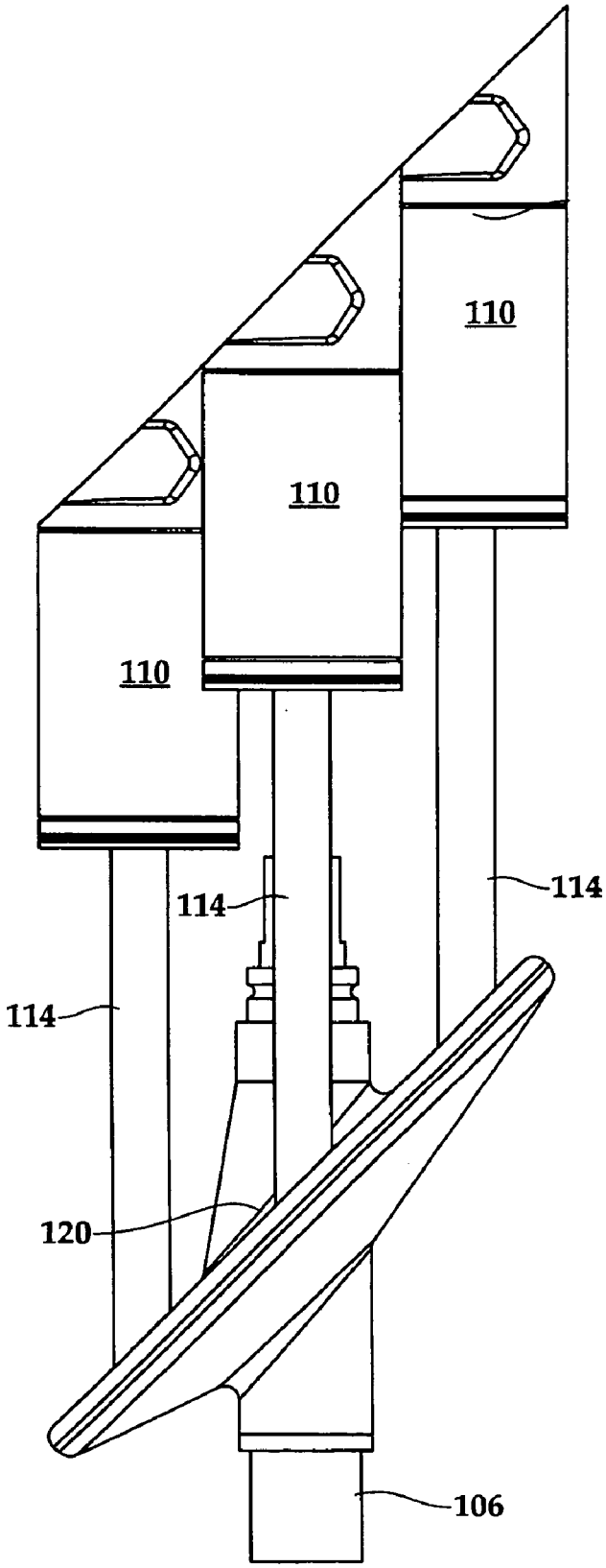
FIG. 4 depicts an right side view of the reciprocating assembly of the internal combustion engine of FIG. 1.
Figure 5:
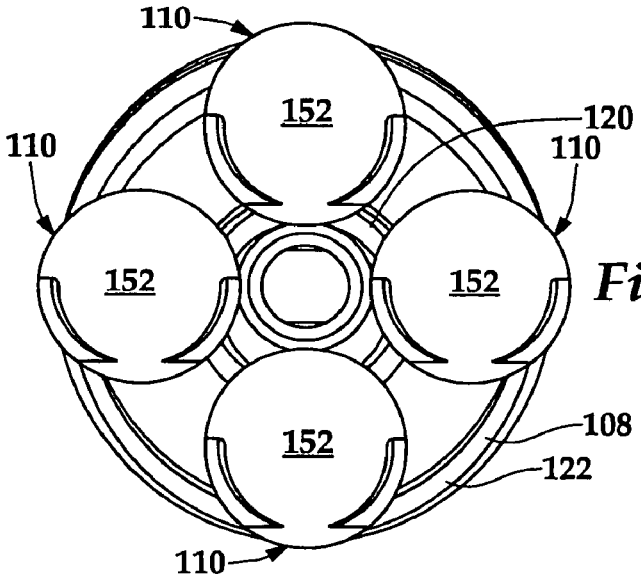
FIG. 5 depicts a top view of the reciprocating assembly of the internal combustion engine of FIG. 1.
Figure 9:
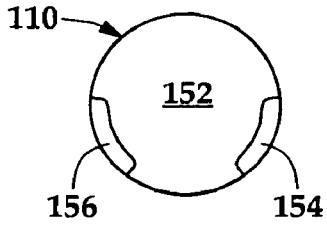
FIG. 9 depicts a top view of a piston used in the reciprocating assembly of FIG. 2.
Figure 6:
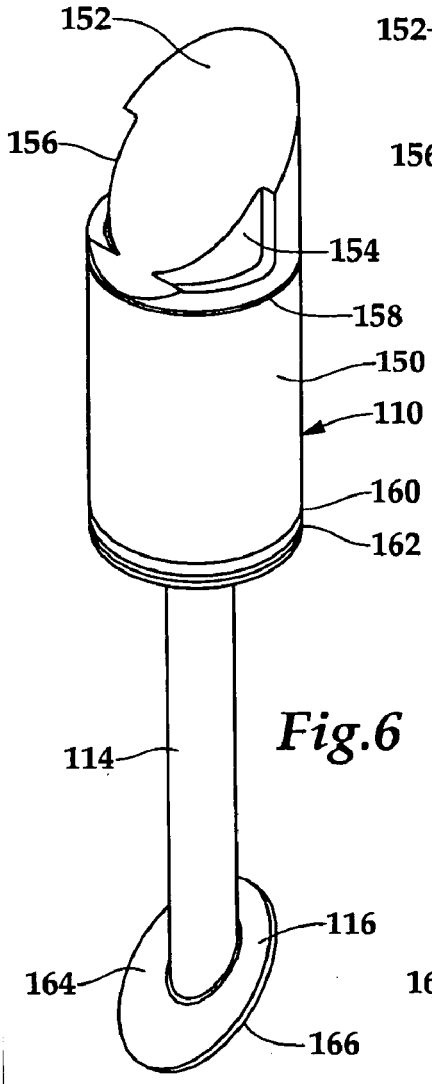
FIG. 6 depicts an isometric view of a piston used in the reciprocating assembly of FIG. 2.
Figure 7:
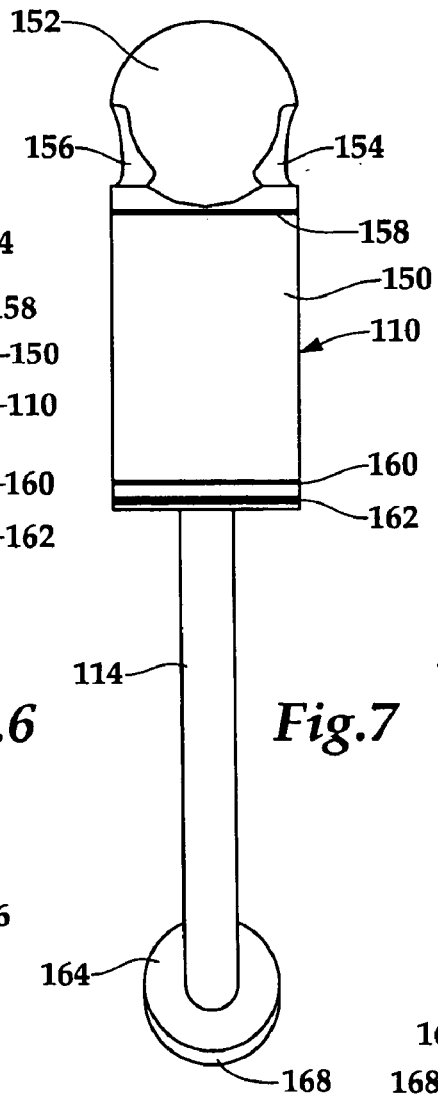
FIG. 7 depicts a front view of a piston used in the reciprocating assembly of FIG. 2.
Figure 8:
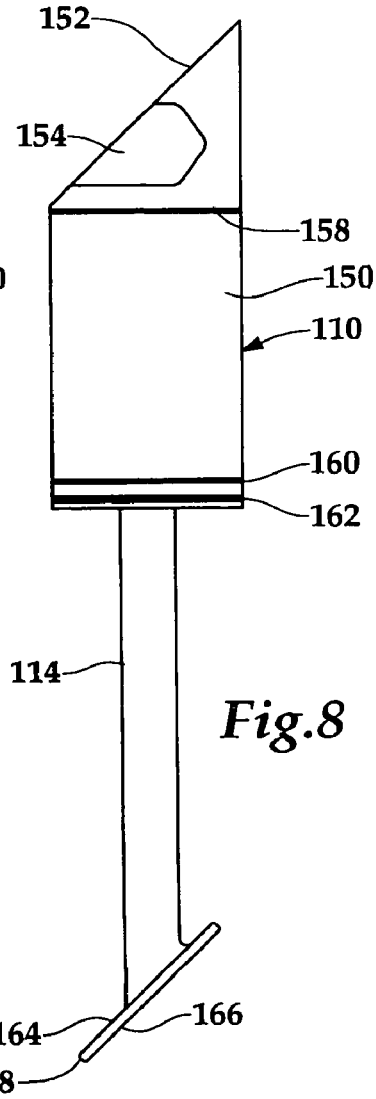
FIG. 8 depicts a side view of a piston used in the reciprocating assembly of FIG. 2.
Figure 10:
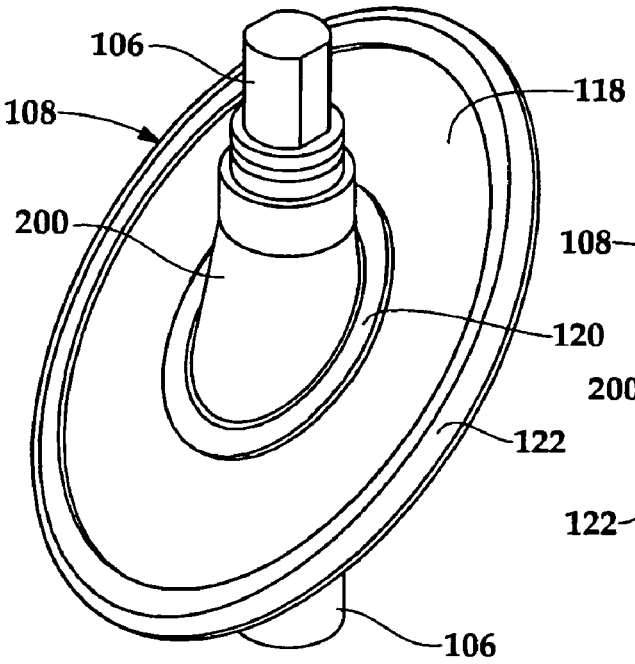
FIG. 10 depicts an isometric view of the swash plate used in the reciprocating assembly of FIG. 2.
Figure 13:
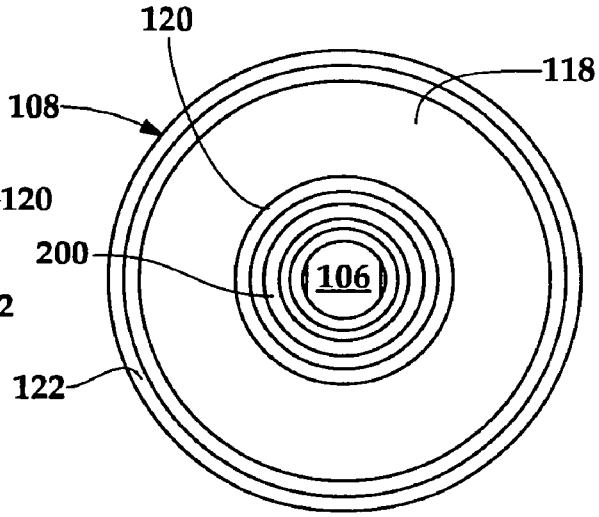
FIG. 13 depicts a top view of the swash plate used in the reciprocating assembly of FIG. 2.
Figure 11:
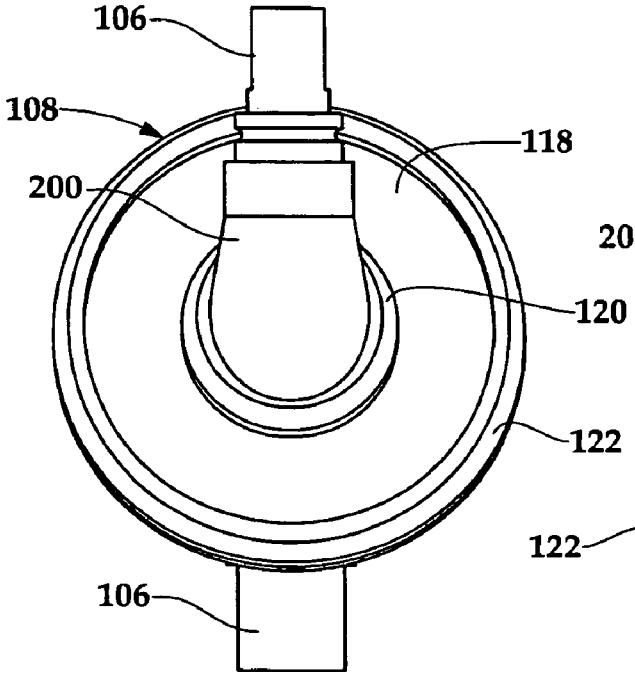
FIG. 11 depicts a front view of the swash plate used in the reciprocating assembly of FIG. 2.
Figure 12:
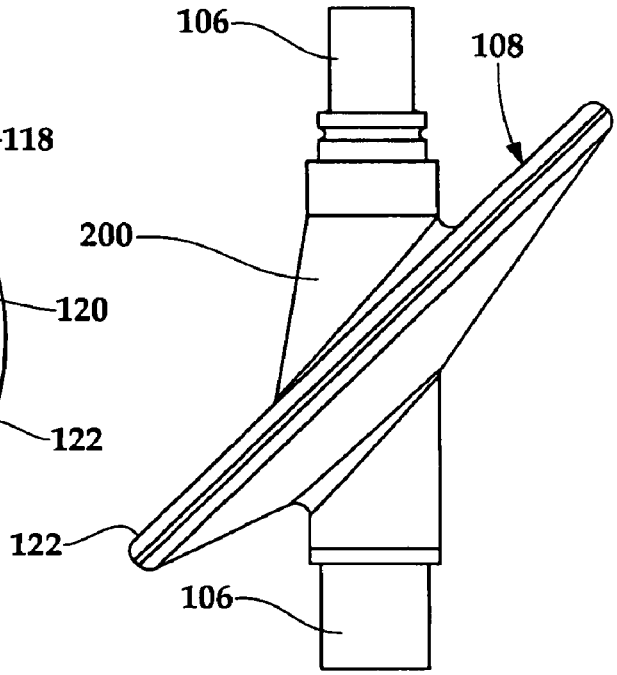
FIG. 12 depicts a side view of the swash plate used in the reciprocating assembly of FIG. 2.

Although the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention, and do not delimit the scope of the invention.

Engine 100 incorporates cylinder block 102 and crankcase 104 disposed about output shaft 106. A swash plate 108 is rigidly secured to the output shaft 106. Swash plate 108 has a generally-planar bearing surface 118 having a normal axis disposed at an angle to the principal longitudinal axis of the output shaft 106. A set of four cylindrical pistons 110 are disposed in four corresponding cylinders 112 and operably connected to swash plate 108 through connecting rods 114 via rod feet 116, which ride on bearing surface 118 of swash plate 108. Each of rod feet 116 has a generally planar bottom surface having a principal normal axis disposed at an angle to the principal longitudinal axis of the connecting rod 114 to which it is secured.

Each piston 110 incorporates a skirt 150 and a crown 152. In the embodiment shown in FIGS. 1–9, the crown 152 incorporates a pair of valve pockets 154 and 156, although alternate embodiments may omit either or both of pockets 154 and 156. Similarly, while pockets 154 and 156 are shown as being symmetrical and having a particular shape, pockets 154 and 156 may have different shapes in alternate embodiments.

Piston skirt 150 incorporates a compression ring groove 158 and oil control rings 160 and 162. Alternate embodiments may incorporate more or fewer piston ring grooves 158–162 as a particular application demands. It will be understood by those of skill in the art that a wide variety of piston ring styles may be employed in the present invention, again depending on the particular application.

Connecting rod 114 connects piston 150 to an elliptical rod foot 116. Rod foot 116 incorporates an upper surface 164, a lower surface 166 and an outer edge 168. When assembled to swash plate 108, rod foot 116 is captured by inner ridge 120 and outer ridge 122 against upper surface 164, while lower surface 166 rides against swash plate bearing surface 118. Swash plate 108 incorporates a conical transition 200 to brace the wash plate 108 against moment loading on the swash plate bearing surface 118.

Those of skill in the art will recognize that engine 100 differs markedly from traditional internal combustion engines. In the most common layout of the traditional internal combustion engine, the engine's pistons are tied to a rotary crankshaft through a set of connecting rods, in order to convert the reciprocal axial motion of the pistons into continuous rotary motion of the crankshaft. Although a wide variety of cylinder layouts have been devised and implemented, including the well-known "V" geometry (as in "V8"), in-line, opposed (also known as "flat") and radial geometries, all such engines share the basic crankshaft geometry described above.

Despite their overwhelming successes, crank-articulated reciprocating powerplants incorporate certain inherent limitations. Except at two discrete points in the range of piston motion—namely top dead center and bottom dead center—the connecting rod is disposed at an angle to the center line of the cylinder within which the piston is exposed. Axial forces in the connecting rod must, therefore, be counteracted at the interface between the piston and the cylinder wall. The load on the cylinder wall by the piston is known as "side loading" of the piston. As the pressure in the cylinder rises, side-loading can become a serious concern, with respect to durability as well as frictional losses. Further, dynamic centrifugal loads on the engine components rise geometrically with engine speed in a crankshaft engine, limiting both the specific power output and power-to-weight ratio of crankshaft engines.

In a crankshaft engine, the geometry of the crankshaft and connecting rod is such that, as the crank rotates and the piston moves through its range of motion, the piston spends more time near bottom dead center (where no power is generated) than near top dead center (where power is generated). This inherent characteristic can be countered somewhat with the use of a longer connecting rod, but the motion of the piston with respect to time can only approach, and cannot ever match, perfectly sinusoidal motion. The magnitude of this effect is inversely related to the ratio of the effective length of the connecting rod to the length of the crankshaft stroke, but is particularly pronounced in engines having a connecting rod-to-stroke ratio at or below 1.5:1.

The rate of acceleration of the piston away from top dead center in an engine having a low rod-to-stroke ratio is such that useful combustion chamber pressure cannot be maintained at higher crank speeds. This occurs because the combustion rate of the fuel-air mixture in the combustion chamber, which governs the pressure in the combustion chamber, is limited by the rate of reaction of the hydrocarbon fuel and oxygen. In a long stroke, short rod engine running at a high crankshaft speed, the increase in volume caused by the piston motion outstrips the increase in pressure caused by combustion. In other words, the piston "outruns" the expanding fuel-air mixture in the combustion chamber, such that the pressure from the expanding mixture does not contribute to acceleration of the piston or, therefore, the crankshaft.

The dwell time of the piston near top-dead-center can be increased somewhat through the use of a larger rod-to-stroke ratio. A larger rod-to-stroke ratio can be achieved either with a shorter stroke or a longer connecting rod. Each of the two solutions presents its own problems. With respect to the use of a shorter stroke, although shorter stroke engine can be smaller and lighter than a longer stroke engine, the advantages are not linear. For example, the length of the crankshaft stroke does not have any effect on the size and weight of the pistons, the cylinder heads, the connecting rods or the engine accessories. A shorter stroke does allow for a somewhat smaller and lighter crankshaft and cylinder block, but even these effects are not linear, that is, a halving of the crankshaft stroke does not allow for a halving of the mass of the crankshaft or cylinder block.

With all other performance-related engine attributes being equal, a shorter-stroke engine will have a proportionally-lower displacement as compared to a longer-stroke engine. Accordingly, the shorter-stroke engine will generally produce a lower torque output as compared to the longer-stroke engine. This lower torque output translates to a lower power output at the same crankshaft speed. Accordingly, the shorter-stroke engine will have to be run at a higher speed in order to generate the same power output. The loss of torque resulting from the lower displacement could also be offset with efficiency enhancements, such as more-efficient valve timing, better combustion chamber design or a higher compression ratio. More efficient valve timing and combustion chamber designs, however, generally require substantial investment in research and development, and the maximum compression ratio in an internal combustion engine is limited by the autoignition characteristics of the engine fuel. For naturally-aspirated engines running premium grade gasoline, there is a practical compression ratio limit of approximately 11:1 imposed by the autoignition characteristics of the fuel-air mixture, thereby limiting the efficiency improvements available from an increase in compression ratio alone.

The lost output caused by the shortening of the stroke can also be recouped by increasing the bore diameter of the engine cylinders, thereby increasing engine displacement. While the displacement of the engine is linearly proportional to the stroke length, it is geometrically proportional to the cylinder bore diameter. Accordingly, a 10% reduction in stroke length can be more than offset with a 5% increase in cylinder bore diameter. All other things being equal, an increase in cylinder bore diameter requires an increase in piston mass, which requires a corresponding increase in connecting rod strength and crankshaft counterweight mass. If two or more of the engine's cylinders are arranged in a line, as is common in most modern crankshaft engines, the larger-diameter cylinders will also require a longer cylinder block, cylinder heads and crankshaft, thereby increasing engine size and weight.

A second approach to increasing the rod-to-stroke ratio is to lengthen the rods. This has the advantage of increasing the rod-to-stroke ratio without reducing the engine displacement. Lengthening the rods while leaving all other parameters of the engine alone, however, will move the top-dead-center position of the pistons further away from the centerline of the crankshaft. In other words, a one-inch increase in connecting rod length will result in a one-inch increase in the distance between the crankshaft centerline and the top of a piston crown at top-dead-center. This will require a corresponding increase in the length of the cylinders in order to provide sufficient operating volume for the pistons. Again, the engine size and mass are increased.

In contrast to the trade-offs inherent in the construction of a traditional crankshaft engine, a swash plate engine of the type depicted and shown herein can move the piston along a sinusoidal profile, thereby increasing the dwell time at top dead center, and therefore the performance potential of the engine.

In addition to the kinematics advantages realized from the use of a swash plate, the movement of the pistons within the cylinders can be exploited to improve the performance and versatility of the engine, and particularly so in a two-stroke configuration, although the design is by no means limited to that configuration. As one of skill in the art can appreciate, alternate embodiments of the present invention may employ any of the power cycles known for producing power in the art of thermodynamics, including but certainly not limited to the four-stroke (Otto) cycle, the Diesel cycle, the Stirling cycle, the Brayton cycle, the Carnot cycle and the Seiliger (5-point) cycle, as examples.

Figure 14:
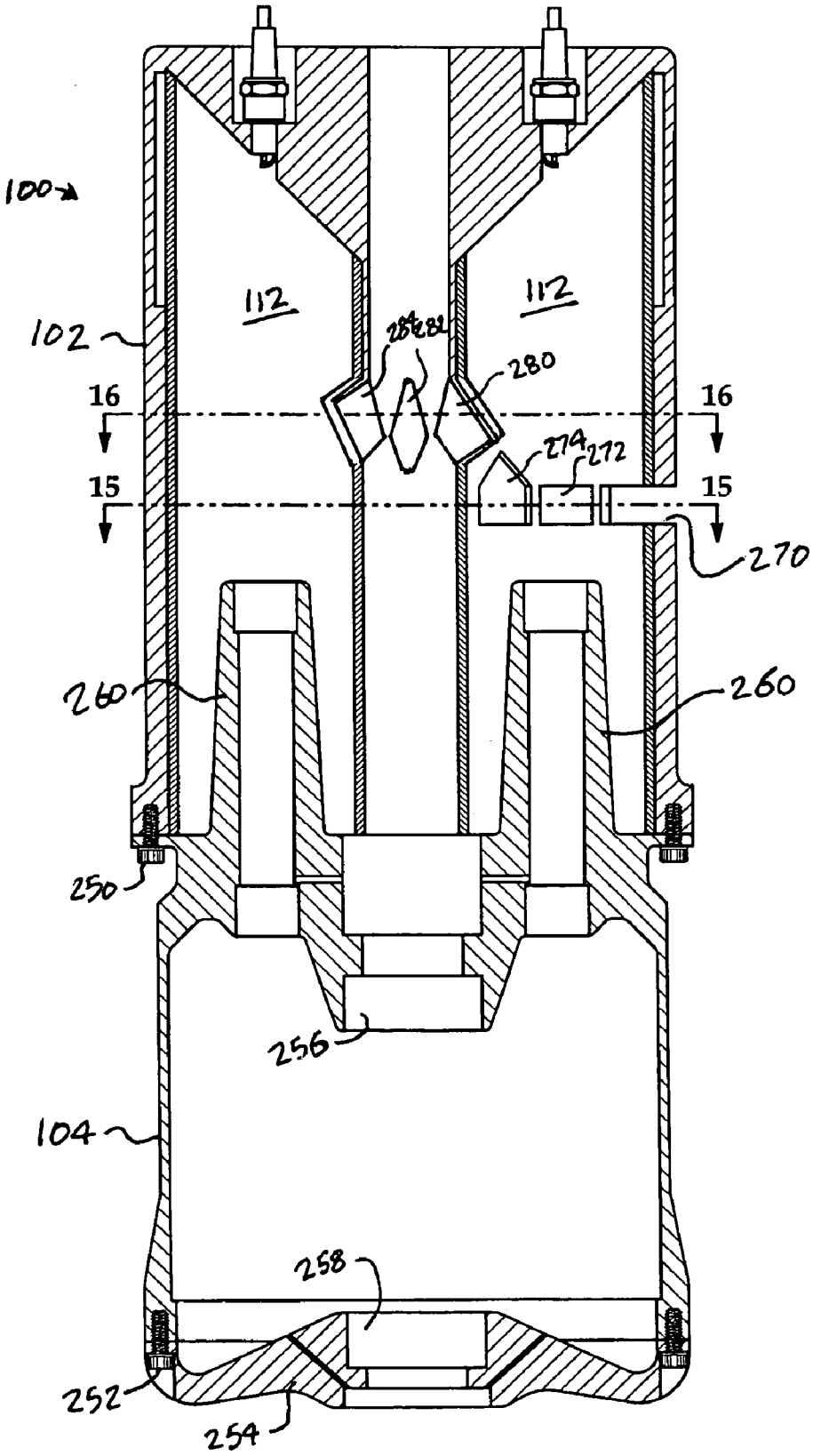
FIG. 14 depicts a side section view of the cylinder head and crankcase assembly of FIG. 1.
Figure 15:
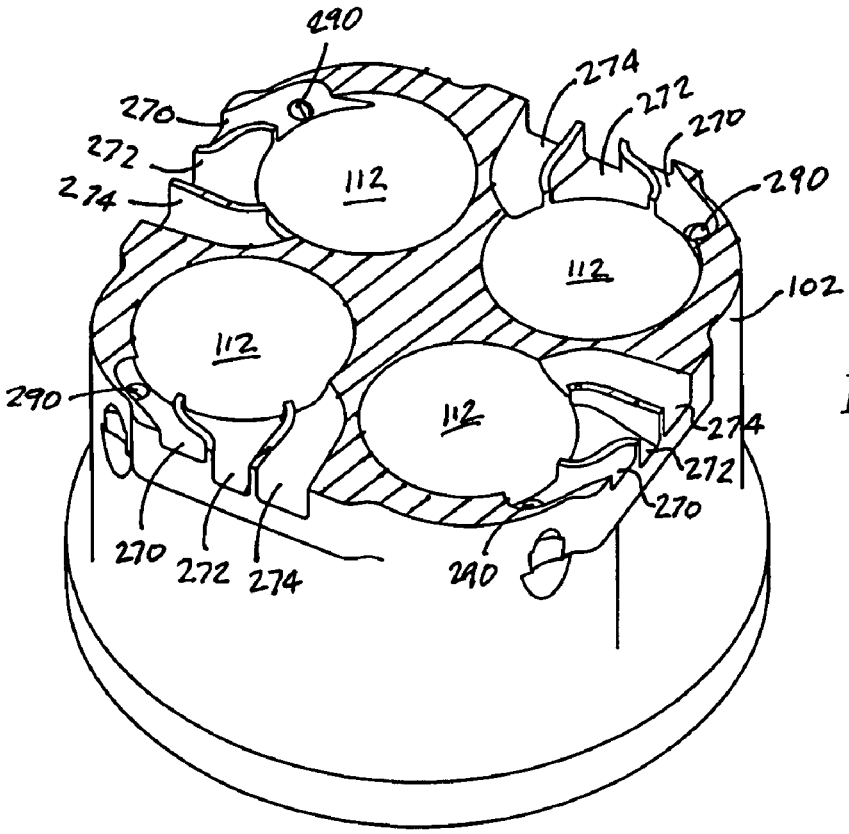
FIG. 15 depicts an isometric section view of the cylinder head along line 15—15 of FIG. 14.
Figure 16:
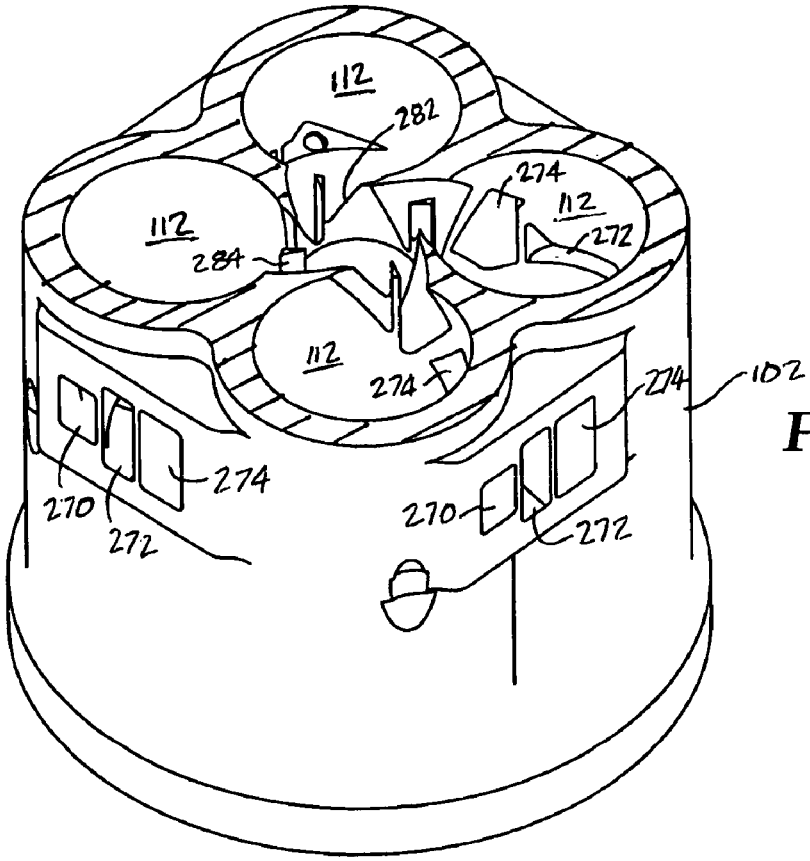
FIG. 16 depicts an isometric section view of the cylinder head along line 16—16 of FIG. 14.

Engine 100 shown in FIGS. 1–16 is a two-stroke configuration, having intake and exhaust ports disposed in the sidewalls of the cylinders 112. The layout of the cylinder block 102 and intake and exhaust porting of engine 100 is shown in detail in FIGS. 14–16. Cylinder block 102 is secured to crankcase 104 by capscrews 250. Cylinder block cover 254 is secured to crankcase 104 by capscrews 252. Swash plate 108 is secured vertically within crankcase 104 between upper bearing race 256 and lower bearing race 258. A set of connecting rod guides 260, shaped and sized to receive and guide the connecting rods 114, is disposed on top of the crankcase 104.

Air and fuel passes into each cylinder 112 through a set of intake ports 270–274. Alternate embodiments may make use of more or fewer intake ports, as appropriate. In the embodiment shown in FIGS. 14–16, fuel is introduced to the intake charge by means of a single fuel injection port 290 disposed in each intake port 270. Depending on the application, alternate embodiments may make use of one or more fuel injection ports disposed in one or more alternate locations, or may make use of carburetion or throttle-body fuel injection, as appropriate. As the piston crown descends on the downward power stroke, burned air/fuel mixture exits each cylinder 112 through one or more exhaust ports, such as ports 280–284.

The flow of intake through ports 270–274 and exhaust through ports 280–284 is controlled by the position and orientation of the piston 110 disposed within each cylinder 112. While traditional two-stroke engine designs have been known to use the axial position of the piston to control the timing of intake and/or exhaust valving, engine 100 employs the axial position of each piston 110 in combination with the radial orientation of each position 110 to control the timing of intake and/or exhaust timing. Accordingly, engine 100 provides a significant degree of additional flexibility to engine designer and tuner as compared to the degree of flexibility available from previous designs.

Although this invention has been described in reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that this description encompass any such modifications or embodiments.

What is claimed is:

1. A power-generation device comprising:

an output shaft, having a central axis;

four cylinders, disposed symmetrically and regularly about the central axis of the output shaft and axially-movable with respect to the output shaft, each having a central axis parallel to the central axis of the output shaft, an internal volume, an internal cylinder surface, a central axis, a first end and a second end;

four cylinder heads, each having an internal cylinder head surface, an intake port, and an exhaust port, each such cylinder head being disposed at, and secured to, the first end of a cylinder;

four pistons, each having an axis of motion aligned to the central axis of a cylinder, disposed in the internal volume of the cylinder and having a crown disposed toward the internal surface of the cylinder head secured to that cylinder, the crown of the piston, an internal cylinder surface, and the internal surface of the cylinder head for that cylinder together forming a combustion chamber for that cylinder;

a swash plate, fixed to the output shaft, having a substantially-planar swash plate surface having a normal axis disposed at an angle of approximately 45 degrees to the central axis of the output shaft;

four connecting rods, each having a principal axis, a first end axially and rotationally fixed to a piston, and a second end; and four followers, each secured to the second end of a connecting rod, respectively, and each having a substantially planar follower surface fixed to the connecting rod and having a normal axis disposed at an angle of approximately 45 degrees to the central axis of the output shaft.

2. The power-generation device of claim 1 wherein the power generation device operates according to the Otto cycle.

3. The power-generation device of claim 1 further comprising at least one fuel injector disposed to inject fuel into each combustion chamber and wherein the power generation device operates according to the Diesel cycle.

4. The power-generation device of claim 1 wherein the power generation device operates according to a dual cycle.

5. The power-generation device of claim 1 wherein at least one cylinder head incorporates a second intake port.

6. The power-generation device of claim 1 wherein at least one intake port is pressurized.

7. The power-generation device of claim 6 further comprising a turbocharger pressurizing at least one intake port.

8. The power-generation device of claim 6 further comprising a supercharger pressurizing at least one intake port.

9. The power generation device of claim 8 wherein:

said power generation device includes at least four cylinders.

10. The power generation device set forth in claim 9 including:

more than four cylinders.

11. A power generation device comprising:

at least three cylinders each having an internal volume, an internal cylinder surface, a central axis, a first end and a second end;

at least three cylinder heads, each having an internal cylinder head surface and each cylinder head being disposed at and secured to said first end of one of said cylinders;

at least three pistons, each having an axis of motion parallel to the central axis of one of said cylinders, disposed in the internal volume of said one cylinder, respectively, and having a crown disposed toward said internal surface of said cylinder head which is secured to said first end of said one of said cylinders, respectively, said crown of said piston, an internal cylinder surface of said one cylinder and said internal surface of said cylinder head for that cylinder together forming a combustion chamber for that cylinder;

an output shaft having a central axis and a fixed angular relationship to the central axis of said cylinders;

a swashplate fixed to said output shaft, having a first swashplate surface having a normal axis disposed at a first fixed angle with respect to said central axis of said output shaft;

at least three connecting rods, each having a principal axis, a first end axially and rotationally fixed to an associated piston and a second end; and at least three followers, each follower being secured to said second end of one of said connecting rods, respectively, and having a first follower surface having a normal axis disposed at a first fixed angle with respect to said principal axis of an associated connecting rod to which it is secured, said first follower surface contacting and conforming to the orientation of said first swashplate surface.

12. The power generation device of claim 11 wherein:

said power generation device operates according to the Otto cycle.

13. The power generation device of claim 11 wherein:

said power generation device operates according to the Stirling cycle.

14. The power generation device of claim 11 further including:

a fuel injector associated with each of said cylinders for injecting fuel into the combustion chambers of said cylinders, respectively, wherein said power generation device operates in accordance with the diesel cycle.

15. The power generation device of claim 11 wherein:

said power generation device operates according to a dual cycle.

16. The power generation device of claim 11 wherein:

said swashplate may be moved axially with respect to said cylinders.

17. The power generation device of claim 11 wherein:

said cylinder heads each include at least one intake port, respectively.

18. The power generation device of claim 17 wherein:

said cylinder heads each incorporate at least two intake ports, respectively.

19. The power generation device of claim 17 wherein:

said one intake port is pressurized, respectively.

20. The power generation device of claim 19 further including:

a supercharger for pressurizing said at least one intake port.

21. The power generation device of claim 20 wherein:

said supercharger comprises a turbo-supercharger.

22. The power generation device of claim 11 further including:

a clocking interface operable to synchronize the orientation of each piston about its central axis to the orientation of said swashplate about said central axis of said output shaft.

23. The power generation device of claim wherein:

said surface of said swashplate is substantially planar.

24. The power generation device of claim 22 wherein:

said normal axis of said swashplate is disposed at an angle of approximately forty-five degrees to said central axis of said output shaft.

25. A power generation device comprising:

an output shaft, having a central axis;

at least three cylinders, disposed symmetrically about the central axis of the output shaft, each cylinder having a central axis parallel to the central axis of the output shaft, an internal volume, an internal cylinder surface, a central axis, a first end and a second end;

at least three cylinder heads, each having an internal cylinder head surface, each cylinder head being disposed at, and secured to, the first end of one of the cylinders, respectively;

at least three pistons, each piston having an axis of motion aligned to the central axis of a cylinder, disposed in the internal volume of the cylinder and having a crown disposed toward the internal surface of the cylinder head secured to that cylinder, the crown of the piston, an internal cylinder surface, and the internal surface of the cylinder head for that cylinder together forming a combustion chamber for that cylinder;

a swashplate, fixed to the output shaft, having a swash plate clocking interface fixed with respect to the orientation of the output shaft about the central axis of the output shaft;

at least three connecting rods, each connecting rod having a principal axis, a first end axially and rotationally fixed to a piston, and a second end; and at least three followers, each secured to the second end of a connecting rod, respectively, and having a follower clocking interface fixed with respect to the orientation of the connecting rod about the principal axis of the connecting rod and the orientation of the swash plate clocking interface.

26. The power generation device of claim 25 wherein:

said power generation device includes at least four cylinders.

27. The power generation device of claim 26 wherein:

said power generation device includes more than four cylinders.

28. The power generation device of claim 25 wherein:

said power generation device operates according to the Otto cycle.

29. The power generation device of claim 25 wherein:

said power generation device operates according to the Stirling cycle.

30. The power generation device of claim 25 further including:

at least one fuel injector disposed to inject fuel into said combustion chamber of each of said cylinders, respectively, and wherein said power generation device operates according to the Diesel cycle.

31. The power generation device of claim 25 wherein:

said power generation device operates according to a dual cycle.

32. The power generation device of claim 25 wherein:

said swashplate clocking interface is a substantially planar surface disposed at an angle to said central axis of said output shaft.

33. The power generation device of claim 32 wherein:

said substantially planar surface is disposed at approximately 45 degrees to said principal axis of said output shaft.

34. A power generation device operating according to the Stirling cycle comprising:

at least one cylinder having an internal volume, an internal cylinder surface, a central axis, a first end and a second end;

at least one cylinder head, having an internal cylinder head surface, each such cylinder head being disposed at, and secured to, the first end of one of the at least one cylinders;

at least one piston, having an axis of motion parallel to the central axis of at least one of the cylinders, disposed in the internal volume of the cylinder and having a crown disposed toward the internal surface of the cylinder head secured to that cylinder, the crown of the piston, an internal cylinder surface, and the internal surface of the cylinder head for that cylinder together forming a combustion chamber for that cylinder;

an output shaft, having a central axis having a fixed angular relationship to the central axis of the cylinder;

a swashplate fixed to the output shaft, having a first swash plate surface having a normal axis disposed at a first fixed angle to the central axis of the output shaft;

at least one connecting rod, having a principal axis, a first end axially and rotationally fixed to a piston, and a second end; and at least one follower, secured to the second end of a connecting rod, having a first follower surface having a normal axis disposed at the first fixed angle to the principal axis of the connecting rod to which it is secured, the first follower surface contacting, and conforming to, the orientation of the first swash plate surface.

35. A power generation device operating according to a dual cycle comprising:

at least one cylinder having an internal volume, an internal cylinder surface, a central axis, a first end and a second end;

at least one cylinder head, having an internal cylinder head surface, each such cylinder head being disposed at, and secured to, the first end of one of the at least one cylinders;

at least one piston, having an axis of motion parallel to the central axis of at least one of the cylinders, disposed in the internal volume of the cylinder and having a crown disposed toward the internal surface of the cylinder head secured to that cylinder, the crown of the piston, an internal cylinder surface, and the internal surface of the cylinder head for that cylinder together forming a combustion chamber for that cylinder;

an output shaft, having a central axis having a fixed angular relationship to the central axis of the cylinder;

a swashplate fixed to the output shaft, having a first swash plate surface having a normal axis disposed at a first fixed angle to the central axis of the output shaft;

at least one connecting rod, having a principal axis, a first end axially and rotationally fixed to a piston, and a second end; and at least one follower, secured to the second end of a connecting rod, having a first follower surface having a normal axis disposed at the first fixed angle to the principal axis of the connecting rod to which it is secured, the first follower surface contacting, and conforming to, the orientation of the first swash plate surface.

36. A power generation device operating according to the Stirling cycle comprising:

an output shaft, having a central axis;

at least two cylinders, disposed symmetrically about the central axis of the output shaft, each having a central axis parallel to the central axis of the output shaft, an internal volume, an internal cylinder surface, a central axis, a first end and a second end;

at least two cylinder heads, each having an internal cylinder head surface, each such cylinder head being disposed at, and secured to, the first end of one of the cylinders;

at least two pistons, each having an axis of motion aligned to the central axis of a cylinder, disposed in the internal volume of the cylinder and having a crown disposed toward the internal surface of the cylinder head secured to that cylinder, the crown of the piston, an internal cylinder surface, and the internal surface of the cylinder head for that cylinder together forming a combustion chamber for that cylinder;

a swash plate, fixed to the output shaft, having a swash plate clocking interface fixed to the orientation of the output shaft about the central axis of the output shaft;

at least two connecting rods, each having a principal axis, a first end axially and rotationally fixed to a piston, and a second end; and at least two followers, each secured to the second end of a connecting rod, having a follower clocking interface fixed to the orientation of the connecting rod about the principal axis of the connecting rod and the orientation of the swash plate clocking interface.

37. A power generation device operating according to a dual cycle comprising:

an output shaft, having a central axis;

at least two cylinders, disposed symmetrically about the central axis of the output shaft, each having a central axis parallel to the central axis of the output shaft, an internal volume, an internal cylinder surface, a central axis, a first end and a second end;

at least two cylinder heads, each having an internal cylinder head surface, each such cylinder head being disposed at, and secured to, the first end of one of the cylinders;

at least two pistons, each having an axis of motion aligned to the central axis of a cylinder, disposed in the internal volume of the cylinder and having a crown disposed toward the internal surface of the cylinder head secured to that cylinder, the crown of the piston, an internal cylinder surface, and the internal surface of the cylinder head for that cylinder together forming a combustion chamber for that cylinder;

a swashplate, fixed to the output shaft, having a swash plate clocking interface fixed to the orientation of the output shaft about the central axis of the output shaft;

at least two connecting rods, each having a principal axis, a first end axially and rotationally fixed to a piston, and a second end; and at least two followers, each secured to the second end of a connecting rod, having a follower clocking interface fixed to the orientation of the connecting rod about the principal axis of the connecting rod and the orientation of the swash plate clocking interface.

38. A power generating engine comprising:

plural spaced apart parallel cylinders, each having an internal volume, an internal cylinder surface, a central axis and first and second ends;

respective cylinder heads for each of said cylinders having an internal cylinder head surface and being disposed at said first end of said cylinders, respectively;

respective pistons disposed in each of said cylinders and having an axis of motion parallel to said central axes of said cylinders, respectively, said pistons each having a crown disposed facing toward respective ones of said cylinder heads and defining with said cylinder heads and said internal cylinder surfaces respective combustion chambers;

an output shaft disposed between said cylinders generally centrally and having a central shaft axis disposed at a fixed angular relationship with respect to the central axes of said cylinders;

a swashplate fixed to said output shaft and having a planar bearing surface disposed at a fixed angle with respect to said central axis of said output shaft;

connecting rod parts having first ends fixed axially and rotationally to said pistons, respectively, said connecting rod parts each being connected at their opposite ends to followers; and said followers include respective follower surfaces having a normal axis disposed at a fixed angle to the central axes of said pistons, respectively, said follower surfaces being disposed for sliding engagement with said bearing surface of said swashplate for effecting rotation of said output shaft in response to movement of said pistons in said cylinders, respectively.

39. The engine set forth in claim 38 wherein:

said swashplate includes at least one circumferential ridge engageable with said followers, respectively, for retaining said followers engaged with said bearing surface.

40. The engine set forth in claim 39 wherein:

said swashplate includes at least two spaced apart circumferential ridges engageable with said followers for retaining said followers engaged with said bearing surface.

41. The engine set forth in claim 38 including:

a generally conical shaped transition part interposed said swashplate and said output shaft for bracing said swashplate against loading imposed on said bearing surface.

42. The engine set forth in claim 38 including:

spaced apart intake and exhaust ports opening into said cylinders, respectively, and disposed at said cylinders in positions to provide for intake and discharge of fluid with respect to said cylinders and dependent on the axial and rotational position of said pistons in said cylinders, respectively.

43. The engine set forth in claim 38 wherein:

said cylinders are formed in a cylinder block connected to a crankcase part of said engine, said crankcase part including respective connecting rod guides shaped and sized to receive and guide said connecting rods, respectively.

44. The engine set forth in claim 43 including:

spaced apart bearing surfaces on said crankcase for journaling said output shaft for rotation therewithin.

* * * * *